US007400337B2

(12) United States Patent
Mindler

(10) Patent No.: US 7,400,337 B2
(45) Date of Patent: Jul. 15, 2008

(54) SYSTEM AND METHOD FOR EFFICIENT DONOR MATERIAL USE

(75) Inventor: Robert F. Mindler, Churchville, NY (US)

(73) Assignee: Eastman Kodak Company, Rochester, NY (US)

( * ) Notice: Subject to any disclaimer, the term of this patent is extended or adjusted under 35 U.S.C. 154(b) by 281 days.

(21) Appl. No.: 11/060,178

(22) Filed: Feb. 17, 2005

(65) Prior Publication Data

US 2006/0181597 A1 Aug. 17, 2006

(51) Int. Cl.
*B41J 2/325* (2006.01)

(52) U.S. Cl. ..... 347/217

(58) Field of Classification Search ..... 347/176, 347/193, 212, 171–172, 218; 346/76.1, 118; 400/120.01, 120.02, 226
See application file for complete search history.

(56) References Cited

U.S. PATENT DOCUMENTS 5,445,463 A 8/1995 Paranjpe et al.
5,567,066 A 10/1996 Paranjpe et al.
6,121,987 A * 9/2000 Sasaki et al. ..... 347/176
6,593,952 B1 * 7/2003 Funayama et al. ..... 347/193

* cited by examiner

*Primary Examiner*—K. Feggins
(74) *Attorney, Agent, or Firm*—Roland S. Schindler

(57) ABSTRACT

In a first aspect of the invention, a method is provided for operating a thermal printer adapted to print images by transferring donor material from patches of donor material from a donor ribbon onto a receiver medium, said printer being operable to print images in a manner that exhausts a full donor patch set or a fractional donor patch set during printing. In accordance with the method, a print order is received and it is determined whether a fractional donor patch set is available for printing. An image is printed using donor material from the fractional donor patch set where at least part of the print order can be satisfied using donor material from the fractional donor patch set.

10 Claims, 4 Drawing Sheets

SYSTEM AND METHOD FOR EFFICIENT DONOR MATERIAL USE

CROSS REFERENCE TO RELATED APPLICATIONS

Reference is made to commonly assigned, co-pending patent application U.S. Ser. No. 11/060,177, entitled SYSTEM AND METHOD FOR EFFICIENT DONOR MATERIAL USE, filed concurrently herewith in the names of Mindler et al.

FIELD OF THE INVENTION

The present invention relates to thermal printers that record images by transferring donor materials from a donor ribbon and methods for operating the same to improve the printing of the use of donor material.

BACKGROUND OF THE INVENTION

In thermal printing, it is generally well known to render images by heating and pressing one or more donor materials such as a dye, colorant or other coating against a receiver medium. The donor materials are provided in sized donor patches on a movable web known as a donor ribbon. The donor patches are organized on the ribbon into donor patch sets, each donor patch set contains all of the donor patches that are to be used to record an image on the receiver medium. For full color images, multiple colored dye sets can be used, such as yellow, magenta and cyan donor dye patches. Arrangements of other color patches can be used in like fashion within a donor patch set. Additionally, each donor set can include an overcoat or sealant layer.

It will be appreciated from this that the size of the donor patches defines the full size image that can be printed using a conventional thermal printer. To provide flexibility of use, many thermal printers are capable of printing relatively large images such as 6"×8" images. While prints of this size are highly desirable for many uses, it can be challenging to use and store images printed at this size. Accordingly, consumers often request that such printers render images at a fraction of the full size image, such as images printed at the wallet size, 3"×5" size or 4"×6" size. Images at these sizes are more easily used and stored and exhausts only a fraction of the donor material from a donor patch set leaving a fraction donor patch set.

Unfortunately, the printers of the prior art are not adapted to use the remaining donor material from a fractionally used donor patch set for printing other images. Instead, it is conventionally known to have a thermal printer advance to the next complete donor set after printing a fractional size image so that the thermal printer is prepared to print any size image when the next printing order is received. It will be appreciated that this results in inefficient use of the donor material causing increased printing expense. What is needed therefore is a thermal printer control system and a method that enables more efficient use of donor material.

SUMMARY OF THE INVENTION

In a first aspect of the invention, a method is provided for operating a thermal printer adapted to print images by transferring donor material from patches of donor material from a donor ribbon onto a receiver medium, said printer being operable to print images in a manner that exhausts a full donor patch set or a fractional donor patch set during printing. In accordance with the method, a print order is received and it is determined whether a fractional donor patch set is available for printing. An image is printed using donor material from the fractional donor patch set where at least part of the print order can be satisfied using donor material from the fractional donor patch set.

In another aspect of the invention, a control system is provided for a thermal printer adapted to print images by transferring donor material from patches of donor material on a donor ribbon to form an image on a receiver medium, said printer being operable to print images in a manner that exhausts a full donor patch set or in a manner that exhausts a fractional donor patch set during printing. The control system has a controller adapted to receive a print order, to determine whether a fractional donor patch set is available for printing; and to print an image using donor material from the fractional donor patch set where at least part of the print order can be satisfied using donor material from the fractional donor patch set.

In still another aspect of the invention, a control system is provided for operating a thermal printer adapted to print images by transferring donor material from donor patch sets from onto a receiver medium, the printer being operable to print images in a manner that exhausts a full donor patch set or a fractional donor patch set during printing. The control system has a means for receiving a print order, a means for determining whether a fractional donor patch set is available for printing; and a control means for receiving a print order, determining whether a fractional donor patch set is available for printing an image using donor material from the fractional donor patch set where at least part of the print order can be satisfied using donor material from the fractional donor patch set.

DETAILED DESCRIPTION OF THE INVENTION

Figure 1:
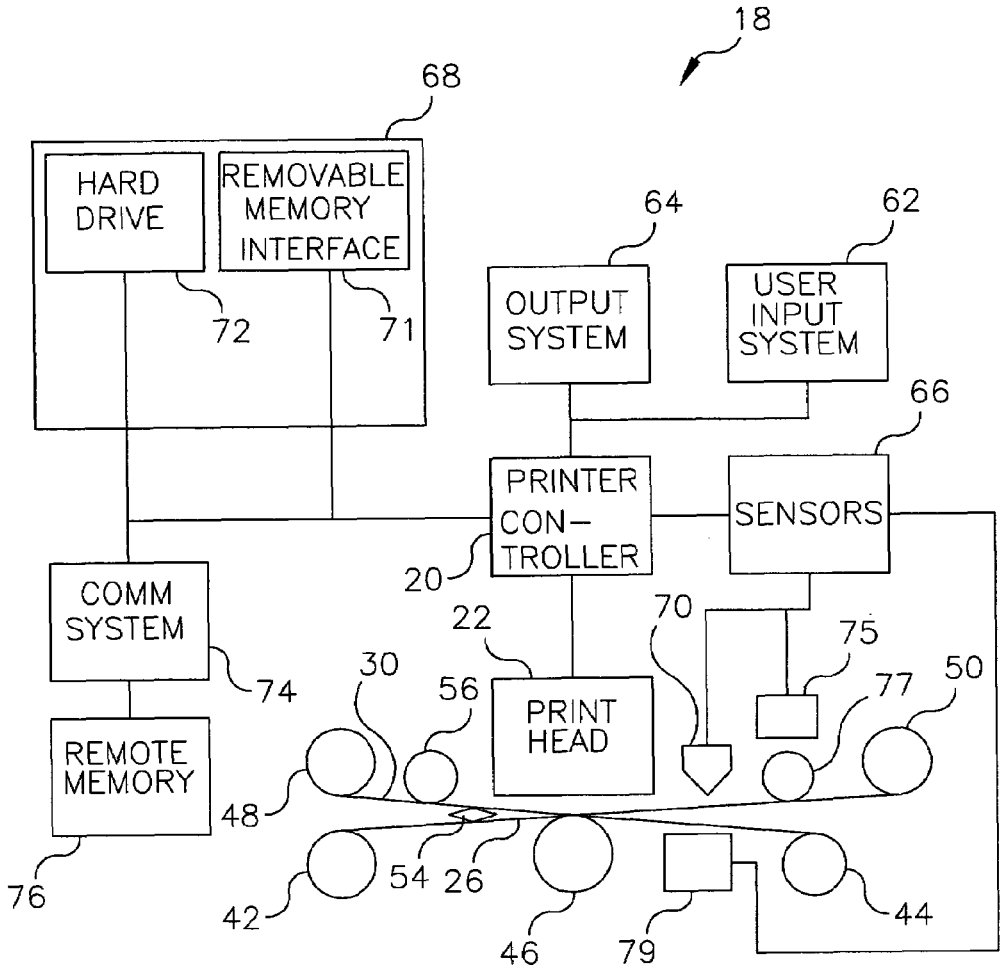
FIG. 1 shows a first embodiment of a printer.

FIG. 1 shows a first embodiment of a printer of the invention. As is shown in FIG. 1, in this embodiment of the invention a printer 18 is provided having a printer controller 20. Printer controller 20 causes print head 22 to record images on a receiver medium 26 by transferring material from a donor ribbon 30 to receiver medium 26. Printer controller 20 can include but is not limited to a programmable digital computer, a programmable microprocessor, a programmable logic controller, a series of electronic circuits or a series of electronic circuits reduced to the form of an integrated circuit, or a series of discrete components. In the embodiment of FIG. 1, printer controller 20 also controls a receiver medium take-up roller 42, a receiver medium supply roller 44, a donor ribbon take-up roller 48 and a donor ribbon supply roller 50, which are each motorized for rotation on command of the printer controller 20 to effect movement of receiver medium 26 and donor ribbon 30. Printer controller 20 receives input signals from a user input system 62, an output system 64, sensors 66, a memory 68 and a communication system 74 and uses these input signals for operating printer 18.

Figure 2:
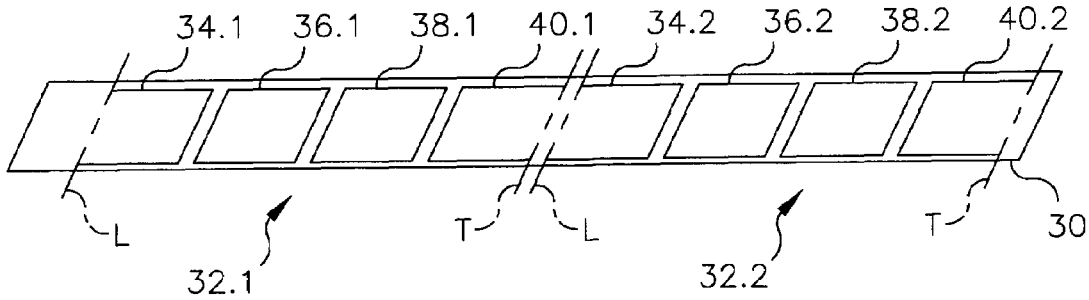
FIG. 2 shows one embodiment of a donor ribbon.

As is shown in FIG. 2, donor ribbon 30 comprises a first donor patch set 32.1 having a yellow donor patch 34.1, a magenta donor patch 36.1, a cyan donor patch 38.1 and a clear overcoat patch 40.1 and a second donor patch set 32.2 having a yellow donor patch 34.2, a magenta donor patch 36.2, a cyan donor patch 38.2 and a clear overcoat patch 40.2. Each donor patch set has a leading edge (L) and a trailing edge (T). In order to provide a full color image with a clear protective coating, the four patches of each set 32.1 and 32.2, etc. are printed, in registration with each other, onto a common image receiving area 52 of receiver medium 26 shown in FIG. 3.

Figure 3:
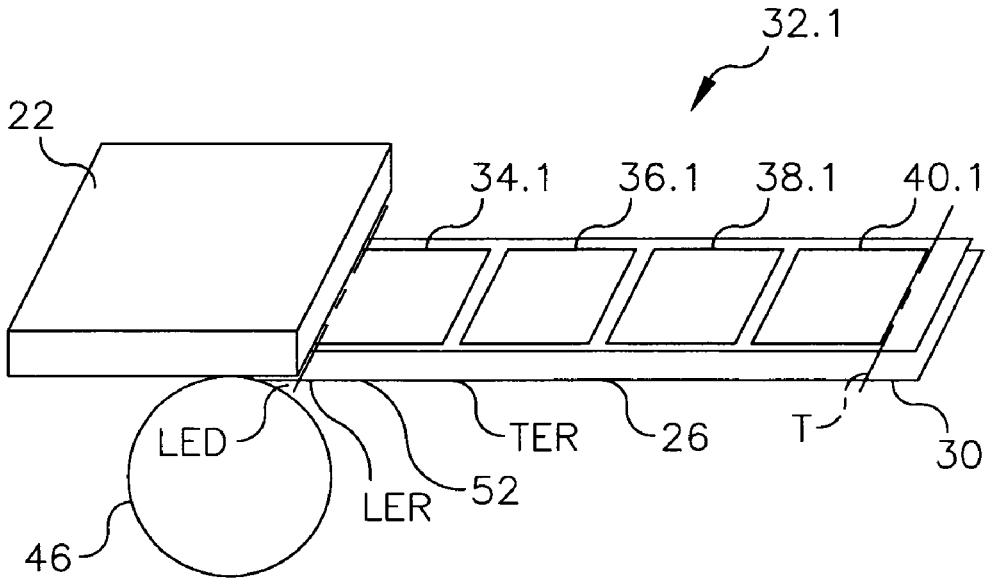
FIG. 3 shows a print head, donor ribbon and receiver ribbon at a start of a first printing process for a first donor patch.

A first color is printed in the conventional direction, from right to left as seen by the viewer in FIGS. 1 and 3. During printing, printer controller 20 raises print head 22 and actuates donor ribbon supply roller 50 and donor ribbon take-up roller 48 to advance a leading edge L of a first donor patch set 32.1 to print head 22. In the embodiment illustrated in FIGS. 1-3, leading edge L for first donor patch set 32.1 is defined by at a leading edge of a yellow donor patch 34.1. The position of this leading edge L can be determined by using a position sensor to detect a marking, indicia on donor ribbon 30 that has a known position relative to the leading edge of yellow donor patch 34.1 or by directly detecting leading edge of yellow donor patch 34.1 as will be discussed in greater detail below.

Printer controller 20 also actuates receiver medium take up roller 42 and receiver medium supply roller 44 so that image receiving area 52 of receiver medium 26 is positioned with respect to the print head 22. In the embodiment illustrated, the image receiving area 52 is defined by a leading edge LER and a trailing edge TER on receiver medium 26. When donor ribbon 30 and receiver medium 26 are positioned so that leading edge LED of yellow donor patch 34.1 is registered at print head 22 with leading edge LER of image receiving area 52. Printer controller 20 then lowers print head 22 so that a lower surface of donor ribbon 30 engages receiver medium 26 which is supported by the platen roller 46.

Figure 4:
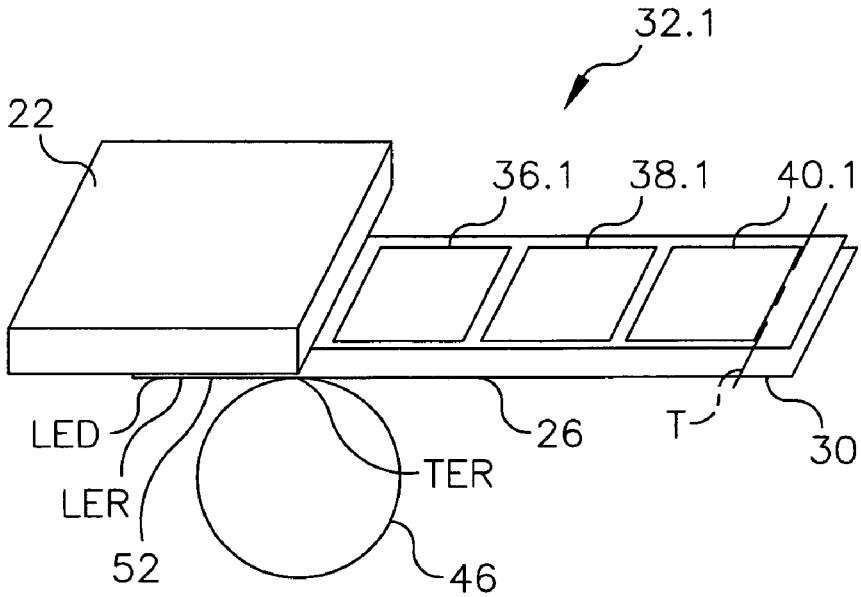
FIG. 4 shows a print head, donor ribbon and receiver ribbon at a conclusion of a first printing process for a first donor patch.

Printer controller 20 then actuates receiver medium take-up roller 42, receiver medium supply roller 44, donor ribbon take-up roller 48 and donor ribbon supply roller 50 to move receiver medium 26 and donor ribbon 30 together past the print head 22. Printer controller 20 selectively operates heater elements (not shown) in print head 22 to transfer donor material yellow donor patch 34.1 to receiver medium 26. As donor ribbon 30 and receiver medium 26 leave the print head 22, a stripping plate 54 separates donor ribbon 30 from receiver medium 26. Donor ribbon 30 continues over idler roller 56 toward the donor ribbon take-up roller 48. As shown in FIG. 4, the trailing edge TER of image receiving area 52 of receiver medium 26 remains on platen roller 46. Printer controller 20 then adjusts the position of donor ribbon 30 and receiver medium 26 using a predefined pattern of donor ribbon movement so that a leading edge of each of the remaining donor patches 36.1, 38.1 and 40.1 in the first donor patch set 32.1 are brought into alignment with leading edge LER of image receiving area 52 and the printing process is repeated to transfer further material as desired to complete image format.

Printer controller 20 operates the printer 18 based upon input signals from a user input system 62, an output system 64, sensors 66, a memory 68 and a communication system 74.

User input system 62 can comprise any form of transducer or other device capable of receiving an input from a user and converting this input into a form that can be used by printer controller 20. For example, user input system 62 can comprise a touch screen input, a touch pad input, a 4-way switch, a 6-way switch, an 8-way switch, a stylus system, a trackball system, a joystick system, a voice recognition system, a gesture recognition system or other such systems. An output system 64, such as a display, is optionally provided and can be used by printer controller 20 to provide human perceptible signals for feedback, informational or other purposes.

Sensors 66 can include light sensors and other sensors known in the art that can be used to detect conditions in the environment-surrounding printer 18 and to convert this information into a form that can be used by printer controller 20 in governing printing operation. In the embodiment of FIG. 1, sensors 66 include a donor position sensor 70 that is adapted to detect the position of donor ribbon 30 and a receiver medium position sensor 79. Printer controller 20 cooperates with donor position sensor 70 to monitor donor ribbon 30 during movement thereof so that printer controller 20 can detect one or more conditions on donor ribbon 30 that indicate a leading edge of a donor patch set. In this regard, a donor ribbon 30 can be provided that has markings or other optically, magnetically or electronically sensible indicia between each donor frame set. Where such markings or indicia are provided, position sensor 70 is provided to sense these markings or indicia and to provide signals to printer controller 20. Printer controller 20 can use these markings and indicia to determine when donor ribbon 30 is positioned with the leading edge of the donor patch set at print head 22. In a similar way, printer controller 20 can use signals from receiver medium position sensor 79 to monitor the position of the receiver to align receiver medium 26 during printing.

During a full image printing operation, printer controller 20 causes donor ribbon 30 to be advanced in a predetermined pattern of distances so as to cause a leading edge of each of the first donor patches 34.1, 36.1, 38.1 and 40.1 to be properly positioned relative to the image receiving area 52 at the start each printing process. Printer controller 20 can be adapted to achieve such positioning by precise control of the movement of donor ribbon 30 using a stepper type motor for motorizing donor ribbon take up roller 48 or donor ribbon supply roller 50 or by using a movement sensor 75 that can detect movement of donor ribbon 30. In one example an arrangement using a movement sensor 75, a follower wheel 77 is provided that engages donor ribbon 30 and moves therewith. Follower wheel 77 can have surface features that are optically, magnetically or electronically sensed by movement sensor 75. One example of this is a follower wheel 77 that has markings thereon indicative of an extent of movement of donor ribbon 30 and a movement sensor 75 that has a light sensor that can sense light reflected by the markings. In other embodiments, perforations, cutouts or other routine and detectable indicia can be incorporated onto donor ribbon 30 in a manner that enables a movement sensor 75 to provide an indication of the extent of movement of the donor ribbon 30.

Alternatively, position sensor 70 can be adapted to sense the color of donor patches on donor ribbon 30 and that can provide color signals to printer controller 20. In this alternative, controller 20 is programmed or otherwise adapted to detect a color that is known to be found in the first donor patch, e.g. yellow donor patch 34.1 in a donor patch set such as first donor patch set 32.1. When the first color is detected, printer controller 20 can determine that donor ribbon 30 is positioned proximate to the start of a donor patch set.

Data including but not limited to control programs, digital images and metadata can also be stored in memory 68.

Memory 68 can take many forms and can include without limitation conventional memory devices including solid state, magnetic, optical or other data storage devices. In the embodiment of FIG. 1, memory 68 is shown having a removable memory interface 71 for communicating with removable memory (not shown) such as a magnetic, optical or magnetic disks. In the embodiment of FIG. 1, memory 68 is also shown having a hard drive 72 that is fixed with printer 18 and a remote memory 76 that is external to printer controller 20 such as a personal computer, computer network or other imaging system.

In the embodiment shown in FIGS. 1-3, printer controller 20 has a communication system 74 for communicating external devices such as remote memory 76. Communication system 74 can be for example, an optical, radio frequency circuit or other transducer that converts electronic signals representing an image and other data into a form that can be conveyed to a separate device by way of an optical signal, radio frequency signal or other form of signal. Communication system 74 can also be used to receive a digital image and other information from a host computer or network (not shown). Printer controller 20 can also receive information and instructions from signals received by communication system 74.

Printer controller 20 is operable to cause printing of at least two differently sized images. In a full image mode, printer controller 20 prints images having image sizes will exhaust most or all of the donor material in the donor patches of a donor patch set. In one example of this type, some images will be sized so that they will require donor material from an entire donor patch. Likewise other combinations of images such as a request for a set of multiple wallet-sized prints will likewise consume substantially all of the donor material available in a single donor patch set. Printer controller 20 is also adapted to print images having various sizes that exhaust only a fraction of the donor material provided by a donor patch set and that leave a fractional donor set having a fraction of donor patches with unused donor material that can be used to form what is referred to herein as a fractional size image.

Conventionally, such donor material is wasted as the conventional printer simply advances the donor ribbon 30 from first donor patch set 32.1 to second donor patch set 32.2 before initiating a next job. However, in the present invention, printer controller 20 is adapted to operate in a novel mode that allows printer controller to execute a first print order using a portion of donor material from a first donor patch set 32.1 and to further use remaining portions of the donor material from the first donor patch set 32.1 to render at least a portion of a second print order.

Figure 5:
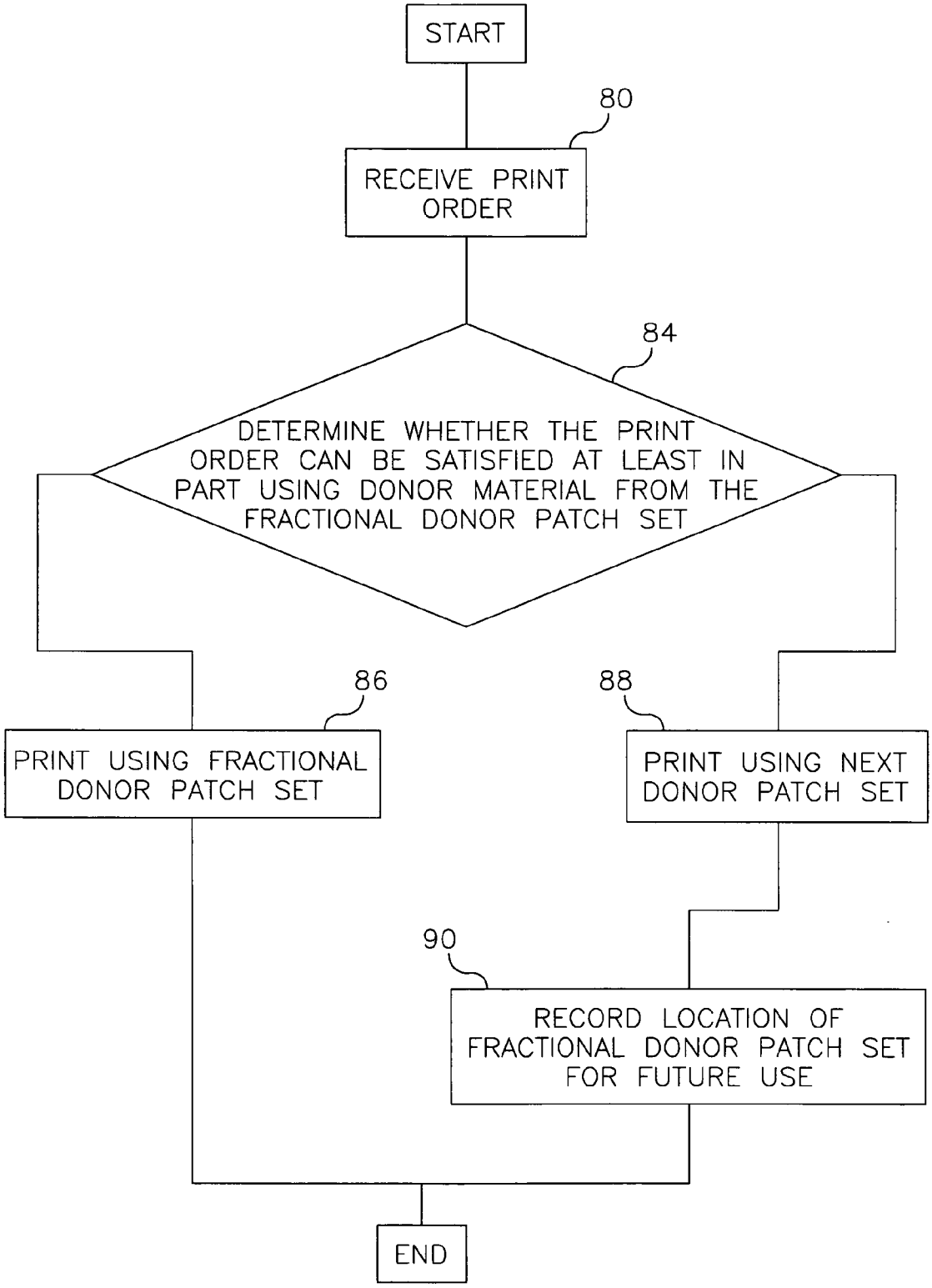
FIG. 5 shows a flow diagram of a method for operating a printer in accordance with the invention.

FIG. 5 provides a flow diagram showing one embodiment of a method for operating a printer 18 in accordance with the invention. As is shown in the embodiment of FIG. 5 an initial print order is received by the printer (step 80). The print order contains instructions sufficient for printer controller 20 to initiate printing operations. Printer controller 20 can receive the print order in a variety of ways including but not limited to receiving entries made by way of user input system 62, signals received at a communication system 74 or in response to a data provided by way of memory 68 including but not limited to data provided by way of a removable memory (not shown).

Each print order generally provides sufficient information from which printer controller 20 can determine what image is to be printed and the quantity of images to be printed. Typically, the order will provide image data for the image to be printed, however, the order can simply designate a location at which the printer can obtain the image data. As is shown in the embodiment of FIG. 5, printer controller 20 determines whether any fractional donor set is available on donor ribbon 30 (step 82).

This can be done in a variety of ways. In one embodiment, printer controller 20 is adapted to store data that indicates whether such a fractional donor set is available. In one embodiment this is done by maintaining a log indicating all print orders executed using donor ribbon 30. In this embodiment printer controller 20 is adapted to analyze the log data to determine whether such a fractional donor set is available. Alternatively, printer controller 20 can be adapted to make a determination after each print job as to whether a fractional donor set is available on donor ribbon 30 and to record a fractional data flag that indicates the availability or non-availability of a fractional donor set on donor ribbon 30.

In certain embodiments of the invention, the log or flag data can be stored in memory 68 of printer 18, however, in other embodiments, the log or flag data can be stored in a memory that is physically associated with the donor ribbon 30. For example, donor ribbon 30 can be physically associated with a memory button of the type sold by Dallas Semiconductor, Dallas, Tex., USA or some other type of memory that printer controller 20 can exchange data with by way of a physical connection. The donor ribbon 30 can also be physically associated with a memory that is capable of exchanging data wirelessly with printer controller 20 for example a radio frequency identification tag can be used to store data and to provide data to printer 18 by way of an exchange of wireless signals with communication system 74.

Optionally, printer controller 20 can also determine characteristics such as the type and size of donor material that remains in a donor patch set so that more refined determinations of the nature of the donor patch set that remains can be made. For the purposes of the discussion, it will be assumed printer controller 20 is adapted cause images to be printed either using an entire donor patch or printed in a fractional mode that uses only one half of the donor material from each donor patch. However, this is done simply for convenience, and it will be appreciated that in other embodiments of the invention, fractional sized printing can involve other fractional sizes such as quarter size, wallet size, or the like. In this regard, printer controller 20 can optionally be adapted to determine the size of the donor material available in a fractional donor patch set from a log or flag.

Printer controller 20 then determines whether the print order can be satisfied at least in part using donor material from the fractional donor patch set (step 84). Where such a portion of the print order can be executed using the remaining donor material in a donor patch set, printer controller 20 will cause the donor ribbon to be positioned so that remaining portions of a fractional donor patch are used in rendering at least a portion of the print order (step 86). Where the print order cannot use the fractional donor set to render the print order, the printer can position a subsequent donor set i.e. second donor patch set 32.2 for use in rendering the job order (step 88). Printer controller 20 can optionally record the location of fractional donor patch e.g. first donor patch set 32.1 so that it can be used in a subsequent print order (step 90), or alternatively, printer controller 20 can ignore that fractional donor patch set but improve donor use efficiency by using donor material from other donor patch sets (not shown).

Figure 6:
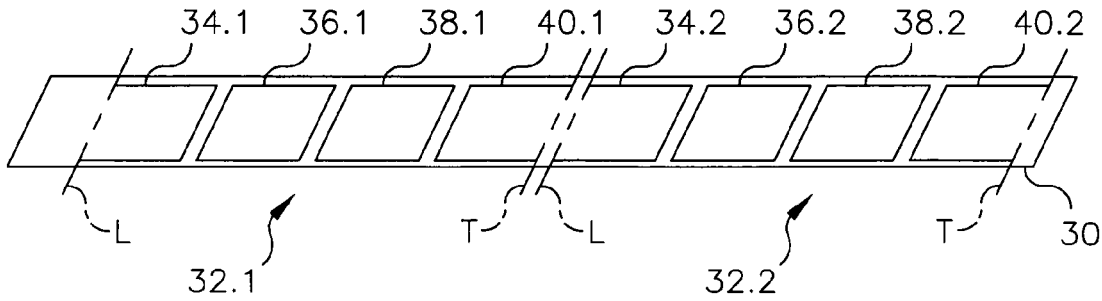
FIG. 6 illustrates a donor ribbon at the start of a first printing operation.
Figure 7:
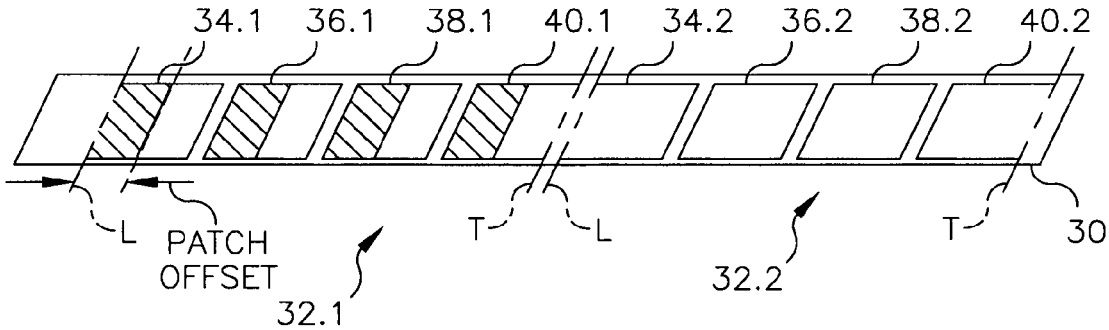
FIG. 7 illustrates the donor ribbon of FIG. 6 after the first printing operation.
Figure 8:
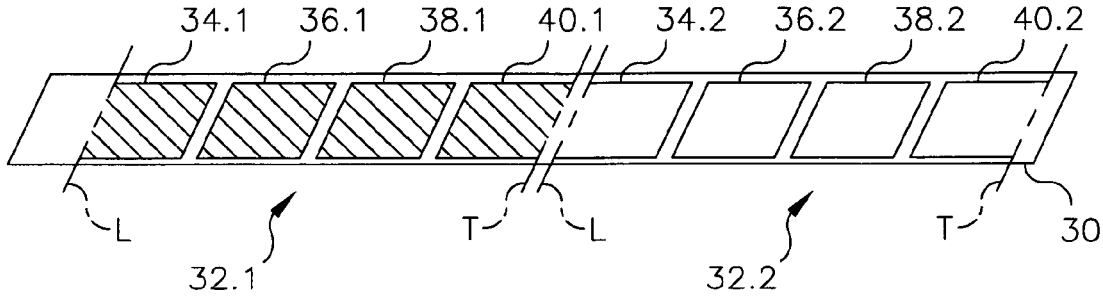
FIG. 8 illustrates the donor ribbon of FIG. 6 after the second printing operation.

FIGS. 6-8 illustrate the application of this method to first donor patch set 32.1. As illustrated in FIG. 6, when printer 18 is at an initial start-up point, donor ribbon 30 has a first donor patch set 32.1 available for print full size printing. Printer controller 20 receives a print order for one half-sized image and causes a half sized image to be printed. As is shown in FIG. 7, at the completion of a first print order of one half-sized image first donor patch set 32.1 has donor patches 34.1, 36.1, 38.1 or 40.1 having half patches of donor material available for printing. In this embodiment, printer controller 20 stores a flag in memory 68 indicating that a fractional donor patch set is available for printing.

At the completion of the first print order, printer controller 20 can cause donor ribbon supply roller 50 and donor ribbon take up roller 48 to operate to move donor ribbon 30 from a position of donor ribbon 30 at the completion of the first print order, to a position that aligns first donor patch set 32.1 with print head 22 for printing. In this regard, it will be appreciated that printing of a fractional sized print can be initiated immediately with print head 22 positioned in at this location in the event that printer controller 20 determines that at least a part of a second print order can be rendered using donor material from the fraction of the donor patch set remaining in first donor patch set 32.1.

When a second print order requiring a full sized image is received, printer controller 20 can determine from the flag data that a fractional donor patch is available for printing. Printer controller 20 then determine whether a portion of the full sized image can be printed using the fractional donor patch set 32.1. Where this is possible printer controller 20 can direct any portion of the order that can be printed using donor material from the fractional donor patch set 32.1. Where it is not possible to use the fraction of the first donor patch set 32.1 that remains, printer controller 20 can cause donor media to be advanced so that a leading edge of the first donor patch in the second donor patch set 32.2 can be used for printing the full sized print.

It will be appreciated that, in order to use donor material from the fractional donor patch set 32.1 in rendering a portion of a second print order, printer controller 20 must be capable of properly positioning donor patch set 32.1 so that print head 22 confronts only portions of the donor patches 34.1, 36.1, 38.1 and 40.1 that were not used during satisfaction of the first print order. This requires that printer controller 20 determine which portions of each donor patch remain unused after the first print order and that printer controller is also capable of properly and accurately positioning the donor material relative to print head 22 for printing such sections.

Printer controller 20 determines whether unused portions of the donor patches 34.1, 36.1, 38.1, 40.1, are available for use in printing by analysis of log data, or flag data as described generally above. Printer controller 20 can use this flag data to designate that each of donor patches 34.1, 36.1, 38.1 and 40.1, have half patches of donor material remaining.

Printer controller 20 can controllably position donor ribbon 30 so that portions of a first donor patch set 32.1 can be used in rendering at least a part of a second print order by causing donor ribbon take-up roller 48 and donor ribbon supply roller 50 to reverse the direction of donor ribbon movement after completing the first printing job and by using position sensor 70 to detect the start of first donor patch set 32.1 in the same manner as position sensor 70 can detect the start of first donor patch set 32.1 when donor ribbon 30 is advanced in a forward direction.

Once a donor ribbon 30 that is positioned at the start of fractionally used first donor patch set 32.1, printer controller 20 can determine a usable patch offset distance from the leading edge of each patch and can use the offset distance to adjust the pattern of donor ribbon movement so that only unused fractions of each donor patch are used for printing. Printer controller 20 determines the useable patch offset distance based upon the size of the fractional image printed using the first donor patch and the overall size of the donor patch. For example, where donor patches 34.1, 36.1, 38.1 and 40.1 of first donor patch set 32.1 shown in FIG. 6 are each 6"×8" patches and where the first print order required a first print that was of 6"×4" size, it can be determined that the first print order consumed the first four inches of each donor patch. Accordingly, printer controller 20 determines patch offset distance of 4 inches as is illustrated in FIG. 7. When a subsequent print order is received that requires the printing of a 6"×4" image, printer controller causes donor ribbon 30 to be moved forward four inches from the start the first donor patch in first donor patch set 32.1, yellow donor patch 34.1, and requires that printing begin at that point and continue only for another four inches. Printer controller 20 then moves donor ribbon 30 a distance that is equivalent to a full donor patch plus any inter-patch spacing so that printing of the second donor patch begins four inches from the start of the next donor patch, magenta donor patch 36.1. This process repeats for each donor patch, exhausting all of the donor patches 34.1, 36.1, 38.1, and 40.1 of first donor patch set 32.1.

In this way portions of first donor patch set 32.1 that were not used in rendering a first print order can be used to render at least a part of a second print order.

It will be appreciated that using this approach, a printer controller 20 is provided that is adapted to direct printing orders to thermal printers so that the number of thermal printers that have fractional donor media available for printing at the start of a subsequent printing job is minimized.

The invention has been described in detail with particular reference to certain preferred embodiments thereof, but it will be understood that variations and modifications can be effected within the spirit and scope of the invention.

PARTS LIST

18 printer
20 printer controller
22 print head
26 receiver medium
30 donor ribbon
32.1 first donor patch set
32.2 second donor patch set
34.1 yellow donor patch
34.2 yellow donor patch
36.1 magenta donor patch
36.2 magenta donor patch
38.1 cyan donor patch
38.2 cyan donor patch
40.1 clear overcoat patch
40.2 clear overcoat patch
42 receiver medium take-up roller
44 receiver medium supply roller
46 platen roller
48 donor ribbon take-up roller
50 donor ribbon supply roller
52 image receiving area
54 stripping plate
56 idler roller
62 user input system
64 output system
66 sensors
68 memory
70 position sensor
71 removable memory interface
72 hard drive
74 communication system
75 movement sensor
76 remote memory

77 follower wheel
79 receiver medium position sensor
80 receive print order step
82 determine available fractional sized print step
84 can a portion of the print order be satisfied using the fractional donor patch set
86 use fractional donor set to print
88 use next donor patch set
90 store location at fractional donor patch set

The invention claimed is:

1. A method for operating a thermal printer with a print head adapted to print images by transferring donor material from patches of donor material from a donor ribbon onto a receiver medium, said printer being operable to print images in a manner that exhausts a fill donor patch set or a fractional donor patch set during printing, the method comprising the steps of:

receiving a first print order;

determining whether a fractional donor patch set is available for printing; and printing an image using donor material from the fractional donor patch set where at least part of the first print order can be satisfied using donor material from the fractional donor patch set;

wherein data is stored in an electronic memory inside of the thermal printer and apart from the donor ribbon indicating whether a fractional donor patch set is available for printing, wherein the step of determining whether a fractional donor patch set is available for printing is performed based upon the stored data, and wherein at the completion of the first print order the donor ribbon is moved to a position aligning a fractional donor patch set with the print head in the event that at least part of a second print order can be satisfied using donor material from the fractional donor patch set.

2. The method of claim 1, wherein the step of printing an image using donor material from the fractional donor patch set where at least part of the print order can be satisfied using donor material from the fractional donor patch comprises determining a starting edge for each unused portion of each donor patch in the fractional donor patch set based upon a detected start of the donor patch set and based upon said stored data.

3. The method of claim 2, further comprising the step of determining an offset distance indicating a distance from the leading edge of each patch to which donor ribbon is to be advanced before printing an image using the donor patch and using the offset to determine the staffing edge of each unused portion.

4. A control system for a thermal printer with a print head adapted to print images by transferring donor material from patches of donor material on a donor ribbon to form an image on a receiver medium, said thermal printer being operable to print images in a manner that exhausts a full donor patch set or in a manner that exhausts a fractional donor patch set during printing; and said control system comprising:

a controller adapted to receive a first print order, to determine whether a fractional donor patch set is available for printing; and to print an image using donor material from the fractional donor patch set where at least part of the first print order can be satisfied using donor material from the fractional donor patch set; wherein the controller is adapted to store data in an electronic memory inside of the thermal printer and apart from the donor ribbon indicating whether a fractional donor patch set is available for printing and is adapted to determine whether a fractional donor patch set is available for printing is performed based upon the stored data, and wherein at the completion of the first print order the donor ribbon is moved to a position aligning a fractional donor patch set with the print head in the event that at least part of a second print order can be satisfied using donor material from the fractional donor patch set.

5. The control system of claim 4, wherein the controller is adapted to store data in a memory indicating that a fractional donor patch is available for printing after printing in a manner that exhausts a fractional donor patch.

6. The control system of claim 4, wherein controller is adapted to cause the thermal printer to print an image using donor material from the fractional donor patch set where at least part of the print order can be satisfied using donor material from the fractional donor patch by determining a position of a starting edge for each unused portion of each donor patch in the fractional donor patch set based upon a detected start of the donor patch set and based upon said stored data characterizing the size of an image previously printed using the available fractional donor patch.

7. The control system of claim 6, further comprising the step of determining an offset distance indicating a distance from the leading edge of each patch to which donor ribbon is to be advanced before printing an image using the donor patch.

8. The control system of claim 7, further comprising a position sensor adapted to determine a position of a start of a donor patch set and a donor movement sensor adapted to detect an extent of movement of the donor ribbon during transfer of donor material from the donor ribbon to the receiver medium, wherein said controller is adapted to transfer position donor patches from a fractional donor patch set.

9. A control system for operating a thermal printer with a print head adapted to print images by transferring donor material from patches of donor material on a donor ribbon to form an image on a receiver medium, the thermal printer being operable to print images in a manner that exhausts a full donor patch set or a fractional donor patch set during printing, and said control system comprising:

means for receiving a first print order;

means for determining whether a fractional donor patch set is available for printing; and means for for printing an image using donor material from the fractional donor patch set where at least part of the first print order can be satisfied using donor material from the fractional donor patch set; and wherein data is stored in an electronic memory inside of the thermal printer and apart from the donor ribbon indicating whether a fractional donor patch set is available for printing and a determination whether a fractional donor patch set is available for printing is performed based upon the stored data, and wherein at the completion of the first print order the donor ribbon is moved to a position aligning a fractional donor patch set with the print head in the event that at least part of a second print order can be satisfied using donor material from the fractional donor patch set.

10. The control system of claim 9, further comprising a memory means for storing data indicative of whether a donor ribbon has a fractional donor patch set is available for printing wherein the means for determining whether a fractional donor patch set is available comprises a memory reading means.

* * * * *

UNITED STATES PATENT AND TRADEMARK OFFICE

CERTIFICATE OF CORRECTION

PATENT NO. : 7,400,337 B2
APPLICATION NO. : 11/060178
DATED : July 15, 2008
INVENTOR(S) : Robert F. Mindler et al.

It is certified that error appears in the above-identified patent and that said Letters Patent is hereby corrected as shown below:

| | |
|---|---|
| Claim 1, Col. 9, line 15 | Delete “fill” and insert --full-- |
| Claim 5, Col. 9, line 49 | Delete “staffing” and insert --starting-- |

Signed and Sealed this

Twenty-third Day of December, 2008

JON W. DUDAS
*Director of the United States Patent and Trademark Office*